US011006788B2

(12) United States Patent
Thomas et al.

(10) Patent No.: US 11,006,788 B2
(45) Date of Patent: May 18, 2021

(54) PRODUCT DISPENSER WITH ACTIVE MEDIA DISPLAY

(71) Applicants: Trevor Thomas, Regina (CA); Paul Drouin, White City (CA); Nathan Elliott, Regina (CA); Dwayne Melcher, Regina (CA)

(72) Inventors: Trevor Thomas, Regina (CA); Paul Drouin, White City (CA); Nathan Elliott, Regina (CA); Dwayne Melcher, Regina (CA)

( * ) Notice: Subject to any disclaimer, the term of this patent is extended or adjusted under 35 U.S.C. 154(b) by 699 days.

(21) Appl. No.: 15/349,370

(22) Filed: Nov. 11, 2016

(65) Prior Publication Data

US 2018/0132676 A1 May 17, 2018

(51) Int. Cl.
*A47K 10/38* (2006.01)
*G06Q 90/00* (2006.01)

(52) U.S. Cl.
CPC ..... *A47K 10/38* (2013.01); *G06Q 90/00* (2013.01); *A47K 2010/389* (2013.01)

(58) Field of Classification Search
CPC ... A47K 10/38; A47K 2010/389; G06Q 90/00
See application file for complete search history.

(56) References Cited

U.S. PATENT DOCUMENTS 7,441,360 B2 * 10/2008 Christianson ..... A47G 1/0616 362/276
9,858,748 B2 * 1/2018 Thompson ..... G06F 1/1654
2004/0177624 A1 * 9/2004 Wo ..... F28F 13/00 62/125
2006/0173576 A1 * 8/2006 Goerg ..... A47K 10/3845 700/236
2007/0290588 A1 * 12/2007 Oh ..... F16M 11/04 312/401
2007/0295020 A1 * 12/2007 Lee ..... F16M 13/02 62/259.2
2011/0046911 A1 * 2/2011 Studer ..... A47K 10/24 702/108
2015/0062073 A1 * 3/2015 Heikel ..... G06F 3/041 345/174
2016/0373844 A1 * 12/2016 Owens ..... H04R 1/028
2017/0277272 A1 * 9/2017 Nordin ..... H04B 10/116

* cited by examiner

*Primary Examiner* — Timothy R Waggoner
(74) *Attorney, Agent, or Firm* — King & Schickli, PLLC

(57) ABSTRACT

A product dispenser for the dispensing of a product which will show active visual content to proximate viewers. A visual display module is attached to a user-facing surface of the dispenser cover of a product dispenser, to display active visual content to viewers. The active visual content displayed on the active media surface of the dispenser cover could take many forms including changing electronic displays or a translucent surface which can be optionally illuminated or emphasized based on a controller and power source. The product dispenser can be supplied with the visual display module in place on the dispenser cover, or an OEM product dispenser with an insert blank in place on the dispenser cover could also be sold into which the visual display module could be later installed. A media-ready dispenser cover which could be used to retrofit an existing product dispenser with the ability to receive a visual display module is also disclosed. An advertising method using the product dispenser is also disclosed, with a novel revenue model for no-cost supply of the dispenser to the venue.

12 Claims, 16 Drawing Sheets

PRODUCT DISPENSER WITH ACTIVE MEDIA DISPLAY

This invention is in the field of commercial product dispensers for paper and other types of consumable products, and more specifically discloses a product dispenser with a removable visual display module to allow for advertising on the product dispenser.

BACKGROUND

Companies are always searching for novel opportunities to advertise their products or services, or otherwise provide informational updates, to consumers in their establishments. Traditional advertising channels in business establishments included printed advertising which might be displayed on the walls, or printed leaflets, pamphlets or the like which could be distributed.

Many personal services businesses, including any type of retail business, restaurant or the like, have been looking for additional locations at which advertising material could be displayed to their customers. One of the places where this type of advertising has evolved over the last number of years is in public restroom environments, where in addition to locations for static wall signage, product dispensers for cleaning products and personal hygiene products including soap, paper products and the like, provide additional surfaces on which signage can be mounted. There are other similar locations in public spaces where similar types of product dispensers provide novel advertising opportunities.

One of the problems with printed advertising material is that it is static or fixed in nature—once it is printed, the content is determined until the new material can be printed and replaced. Static advertising such as this is in some applications considered sufficient, although the development of dynamic advertising hardware and opportunities, in which the advertising media can be changed on a periodic basis without the need to constantly reprint and incur the labour of replacement, is in many circumstances considered desirable. One of the dynamic advertising approaches which is taken in many such applications is the mounting of tablets, or computer screens, which can display video advertising or constantly scrolling video-based material. Dynamic advertising installations which use computer displays such as this are one option but they are an option which is significant in terms of cost as well as complexity of installation-specific hardware and requirements are often required to be met to deploy this type of a method which can result in significant expense and complexity which is beyond the resources of many businesses wishing to employ a nonstatic advertising approach.

If it were possible to come up with a means by which active or dynamic advertising material could be displayed to viewers without the cost of a significant hardwired installation such as one which would used traditional computer display hardware, it is believed that this would be considered widely acceptable in the market. in the context of this type of active or dynamic advertising material it is specifically contemplated that active advertising material would be any material which include some type of display state change or the like, which could catch the eye of a viewer in the vicinity—for example the entire display could change, such as changing the image on the computer display, or it may also be the case that advertising media which is displayed could have different areas of the media which would light off or otherwise to be emphasized by a controller and a power source connected thereto. It is believed that in addition to making the actual active advertising media easier and more cost effective to change as well as potentially having a longer lifespan if finished in an active format, active advertising material such as is discussed herein is also more eye-catching to a consumer and may yield greater advertising results to the advertiser.

In addition to finding a more cost-effective way of deployment of active advertising media or material in public spaces and applications, it is also specifically contemplated that there would be a great market opportunity to come up with a way to deploy this type of advertising media or material in relation to pre-existing product dispensers. If it was possible to come up with a means by which active advertising material could be displayed on a product dispenser, in a way that pre-existing product dispensers could be retrofitted with this capability, it is explicitly contemplated that there would be an even greater potential for uptake on this advertising method in the marketplace. The actual advertising method itself, in addition to the hardware associated therewith, might represent a novel improvement over the current state-of-the-art.

Often the installation of static or dynamic advertising and such applications are present is a service provided by third-party advertising companies, who will contract with a particular venue for the access to that venues public spaces for installation of their desired advertising media, and they will pay some type of compensation to the venue for providing that advertising access. In some circumstances where the venue themselves however wish to place their own visual content or otherwise, they would not have any ability to recover the cost of installing the equipment to do so. If it were possible to provide a method of advertising which would enhance the ability of a venue to display active visual content to viewers in their location without the need to incur the cost of purchasing and installing advertising equipment, it is again thought that there would be a significant market segment who would be positively inclined towards acceptance of this type of an approach.

BRIEF SUMMARY

The invention is a product dispenser for the display of active visual content to viewers while allowing for the dispensing of at least one product.

As outlined above, the present invention comprises a product dispenser which is capable of use in the provision of active visual content to viewers, as well as a dispenser cover which can be used to retrofit pre-existing product dispensers to allow for the practice of the method of same.

In a first embodiment the invention comprises a product dispenser for the provision of active visual content to viewers which dispenser comprises a dispensing mechanism for storing and dispensing a product, along with a dispenser cover covering the dispensing mechanism and having a user-facing surface. The user-facing surface includes a visual display module attached to the user-facing surface thereof which has an active media surface thereon which will display active visual content to a viewer in proximity thereto. The visual display module is attached to the user-facing surface by the retaining means, and the active media surface of the module faces in the same direction as the user-facing surface, outwards from the dispenser. The module will display active visual content to proximate viewers, who might be near the dispenser.

The visual display module might be removable, in which case releasable retaining means might be included on the dispenser cover, or in other cases, the visual display module might be permanently attached or integrated with the dispenser cover. Both such approaches are contemplated within the scope of the present invention. It is specifically contemplated that rendering the visual display module removable might be desirable for maintenance purposes.

As outlined above, the visual display module will have its active media surface facing outward from the product dispenser. In some embodiments of the product dispenser, the visual display module may be attached via releasable retaining means in such a way that the active media surface is in a parallel plane to a plane of the user-facing surface of the dispenser cover, and in other cases, the active media surface could be approximately coplanar with the user-facing surface of the dispenser cover i.e. the visual display module with its active media surface might either effectively be positioned on the user-facing surface of the dispenser cover, or in other embodiments might be positioned such that the module was positioned recessed within the user-facing surface of the dispenser cover such that the active media surface was approximately coplanar with the user-facing surface of the product dispenser.

In cases where the visual display module was to be recessed within the dispenser cover, the user-facing surface of the dispenser cover could comprise a module recess extending inwards from the user-facing surface of the dispenser cover to allow for accommodation of the visual display module inside of the user-facing surface thereof—particularly where it was desired to position the active media surface approximately coplanar with the user-facing surface of the product dispenser. The reason for in many cases wanting to present a complete product which has an advertising media surface approximately coplanar with the user-facing surface of the dispenser cover would be to permit for the smoothest outer surface of the dispenser, for cleaning and other purposes.

Where the user-facing surface of the outer dispenser cover includes a module recess, the visual display module which is used could be of coordinating shape in circumference to the module recess such that the visual display module could be retained within the module recess.

The module recess in certain embodiments of the dispenser cover might simply comprise an aperture in the user-facing surface of dispenser cover and in other circumstances or embodiments the module recess could further comprise at least one module support to engage the rear surface of the visual display module and cooperate with the retaining means to hold the module in position within the dispenser cover. The at least one module support might comprise in some embodiments a complete interior surface coveting the interior of the module recess, or in other cases might comprise at least one support flange extending around the inner circumference of the module recess, recessed inwards from the user-facing surface of the dispenser cover, towards the center thereof, so that the visual display module would be circumferentially engaged around the outer circumference of its rear surface by the support flange when retained within the module recess.

In some embodiments of the product dispenser of the present invention, the releasable retaining means might comprise at least one engaging slot in the user-facing surface for engaging a coordinating bendable retaining tab on a rear surface of the visual display module, whereby the cooperation of the at least one engaging slot with a coordinating bendable retaining tab retains the visual display module and position on the user-facing surface and allows for the release of the visual display module therefrom by the bending of the bendable retaining tab to allow for its disengagement from the at least one engaging slot. Many other types of releasable retaining means can be contemplated and all are within the scope of the present invention insofar as they might accomplish the same objective of releasably retaining the visual display module in relation to the user-facing surface of the dispenser cover.

In some embodiments of the product dispenser of the present invention, the dispenser cover and the dispensing mechanism might be integrated into a single component or single parts. In other types of product dispensers, the dispenser cover might be removable and the dispenser cover might include attachment means to allow for attachment of the dispenser cover to the dispensing mechanism and the remainder of the product dispenser. Either type of approach i.e. either an integrated dispenser cover and dispensing mechanism, or a detachable dispensing cover from the remainder of the product dispenser, is contemplated within the scope of the present invention.

The visual display module itself is contemplated to comprise a power source and a controller which can operate in conjunction with the active media surface to provide at least one visual media display option which can be selectively activated for display to the viewer in proximity to visit dispenser by the controller. The power source might in most cases be a battery although it could also be a hardwired power source of some type—both types of power sources are contemplated within the scope of the present invention.

The active media surface itself would effectively comprise some type of an advertising media display surface or signage which could be powered to activate certain aspects thereof in the provision of at least one visual media display option. For example, the active media surface might be a sign of the appropriate size which upon application of power by the controller could be lit up in varying ways to provide a visual attraction or visual indication to a proximate viewer, by which they could view the "active" visual content. Any type of a signage, panel or other type of a media surface which could accomplish the objective of providing at least one visual media display on for display to viewers in proximity to the dispenser upon application at the appropriate time of power by controller are all contemplated within the scope of the present invention. It is specifically contemplated that in some embodiments of the visual display module, the active media surface would comprise an "electronic paper" display, such as is known in the art of electronic displays. Given that the system and method of the present invention is intended to provide an active advertising method at a reasonable cost alternative to the use of full-blown LCD panels or similar computer displays, the electronic paper display option is an attractive one insofar as it would provide the ability to at a reasonable cost display various advertising indications without the need to include a full-blown electronic display and computerized controller associated therewith.

The product dispenser can be adapted to be surface mounted, on a wall or the like, or could alternatively be a dispenser that would sit on a surface such as a tabletop or the like. The two types of product dispensers that are specifically contemplated are sheet dispensers and liquid dispensers—specifically, the dispensing mechanism might be a roll dispensing apparatus for the dispensing of rolled paper products such as toilet paper, paper towels or the like, or could similarly be a folded sheet dispensing apparatus for the dispensing of folded sheet paper products such as paper towels or the like. In other cases where the dispensing mechanism was not a sheet dispensing apparatus for the dispensing of rolled or folded sheet paper products, the dispensing mechanism might also for example be a liquid reservoir with a dispensing valve, the product being a liquid product and the overall product dispenser being a dispenser of a liquid product. These are just two examples of different types of product dispensers in respect of which the method of the present invention could be deployed and practiced.

In addition to the product dispenser of the present invention which integrates a visual display module into the dispenser cover, there is also disclosed the removable visual display module for use in conjunction with the product dispenser, which visual display module comprises an active media surface, a controller and a power source, and is removably attachable to a dispenser cover of a product dispenser. The controller could operate in conjunction with the active media surface to as outlined with respect to the modules above, provide at least one powered visual media display option which can be selectively activated for display to a proximate viewer.

The visual display module could be configured such that the active media surface would be approximately coplanar with the user-facing surface of the product dispenser cover to which it would be attached, when placed thereon. Many different types of active media surfaces could be contemplated, as outlined above as well, but it is specifically contemplated that an "electronic paper" display or the like would be of attraction from an economic and utility perspective to provide the ongoing ability to provide changing visual indication advertising or other informational content on the outer surface of a product dispenser at reasonable cost and requiring little significant maintenance.

In addition to the visual display module which is disclosed as well as the overall product dispenser incorporating the modified dispenser cover and module, there is also disclosed in the invention an additional embodiment which is a dispenser cover for a product dispenser, which can be used to provide adaptability of the product dispenser to display active advertising to viewers. The dispenser cover comprises a protective shell shaped for attachment to and covering up the dispensing mechanism of a product dispenser and having a user-facing surface which includes releasable retaining means for the attachment of a removable visual display module to the user-facing surface thereof. The visual display module would again have an active media surface thereon which when attached thereto faces in the same direction as the user-facing surface of the dispenser cover, and which will display active visual content to a viewer in proximity thereto. This dispenser cover could be a dispenser cover used in the manufacture of new product dispensers, such as paper or liquid dispensers outlined above, in respect of which it was desired to integrate the active advertising media display capability of the present invention, or could also be manufactured for use as a retrofit product, to be retrofit onto pre-existing product dispensers to adapt them for incorporation of the method of the present invention.

The dispenser cover might also include a removable cover which was attached to the retaining means in the absence of a visual display module—that is to say that the dispenser cover of the present invention can be manufactured in such a way that paper, liquid or other product dispensers to which it was desired to provide the capability of the adoption of the method of the present invention could be manufactured with a cover over the retaining means such that the same dispenser cover could be used with or without a visual display module and in the case of no visual display module being present, the retaining means and any aperture or holes or other retaining tabs alike in the user-facing surface of the dispenser cover could be covered by the removable cover.

The dispenser cover could also include on its user-facing surface a module recess extending inward therefrom, having a coordinating inner shape and circumference to engage a visual display module therein. The module recess could also include a module support to engage a visual display module in its retention within the module recess—such as a rear support surface covering the interior of the module recess or a support flange extending around the inner circumference of the module recess and recessed inwards from the user-facing surface of the dispenser cover towards the center of the dispenser unit, such that the visual display module could be circumferentially engaged by the support flange when retained within the module recess.

As outlined above, the retaining means used in the dispenser cover could take many different approaches as a be understood to those skilled in the art of the manufacturer of for example injection molded plastic products and the like. The retaining means could comprise at least one engaging slot in the user-facing surface for engaging a coordinating bendable retaining tab on a rear module surface of the visual display module, whereby the cooperation of each at least one engaging slot with a bendable retaining tab retains the visual display module in position on the user-facing surface and allows for the release of the visual display module there from by the bending of the bendable retaining tab to allow for its disengagement from the at least one engaging slot. It will be understood that many different types of retaining means could be used, with parallel or coordinated modification or manufacture of the visual display modules which it will be desired to retain on the user-facing surface of the dispenser cover and any such approaches contemplated within the scope of the present invention.

The dispenser cover itself as outlined, providing the capability for the attachment of the visual display module in accordance with the present invention, is contemplated to be covered within the scope of the claims expressed herein. However, the dispenser cover might also specifically include the visual display module retained therein by the retaining means—wherein the visual display module comprises a power source and a controller which can operate in conjunction with an active media surface to provide at least one visual media display option which can be selectively activated for display to the viewer by the controller. This could be many different types of active media surfaces and modules including an electronic paper display or the like.

It is explicitly and specifically contemplated that the dispenser cover outlined herein could be manufactured in a way that it was a retrofittable cover for use in the retrofit of an existing product dispenser to provide the use of the active advertising method of the present invention in association therewith. For example the dispenser cover of the present invention can be manufactured in the appropriate shape and size to fit over pre-existing paper product dispensers such as paper towel dispensers and the like, such that with the appropriate attachment hardware manufactured thereon, the dispenser cover of the present invention could be retrofitted or substituted for the cover originally manufactured and in place on such a product dispenser such that pre-existing product dispensers can be retrofitted in a way that the active advertising method of the present invention could be deployed therewith. As specifically outlined above with respect to the actual product dispenser itself of the present invention, the dispenser cover of the present invention can be manufactured for use of many different types of pre-existing product dispensers or product dispensers which were being manufactured in first instance—it is explicitly contemplated that the dispensing mechanism could be a roll dispensing apparatus with the product itself being a roll paper product, a folded sheet dispensing apparatus where the product itself is a folded sheet paper product, or liquid reservoir with a dispensing valve where the product to be dispensed was a liquid product. The method of display of active visual content using the dispenser cover or product dispenser of the present invention can be practiced in many environments and with respect to the dispensers of many different types of products and they are all contemplated within the scope hereof.

In addition to the product dispenser, visual display module and dispenser cover expressed and outlined herein, there is also disclosed a method of providing active advertising in a venue. The method of providing the active advertising in a venue in accordance with the remainder of the present invention comprises the placement of at least one product dispenser in the venue, each product dispenser comprising a dispensing mechanism for storing and dispensing a product, a dispenser cover covering the dispensing mechanism having a user-facing surface which includes releasable retaining means for the attachment of a visual display module to the user-facing surface thereof, and a removable visual display module having an active media surface thereon which will display active visual content to any viewers in close proximity thereto. Following the provision or placement of the at least one product dispenser in the venue, the visual display modules will be attached to the user-facing surfaces of the dispensers by the respective retaining means with the active media surfaces thereof facing in the same direction as the media circus, and visual content it is installed for display on the active media surface of the dispensers in question for specific use in the venue. The dispensers would then be operated that is to say that the visual display modules of being engaged and the varying visual advertising or media indications on the active media surface of the modules in question could be displayed to viewers in proximity to the dispensers. It is specifically contemplated that a product supplier could provide these advertising capable product dispensers to the venue at no cost to the venue in exchange for the venue purchasing the product to be dispensed with the dispenser from the supplier—that is to say that a business method of providing venues with advertising capable product dispensers at no cost to them could be deployed.

The method of the present invention would use any type of a product dispenser that is otherwise in accordance with the product dispenser outlined herein—that is to say a visual display module for example would likely comprise a power source for the controller which can operate in conjunction with the active media surface thereof to provide at least one powered visual media display option which can be selectively activated for display to the viewer by the controller. The active media surface could comprise an electronic paper display or the like.

It will be understood that there are many different approaches which could be taken to certain aspects of the problem and opportunity identified by the present invention and all such brooches and modifications as would be obvious to those skilled in the art are contemplated within the scope of the present invention.

BRIEF DESCRIPTION OF THE DRAWINGS

To easily identify the discussion of any particular element or act, the most significant digit or digits in a reference number refer to the figure number in which that element is first introduced.

DETAILED DESCRIPTION

Figure 1:
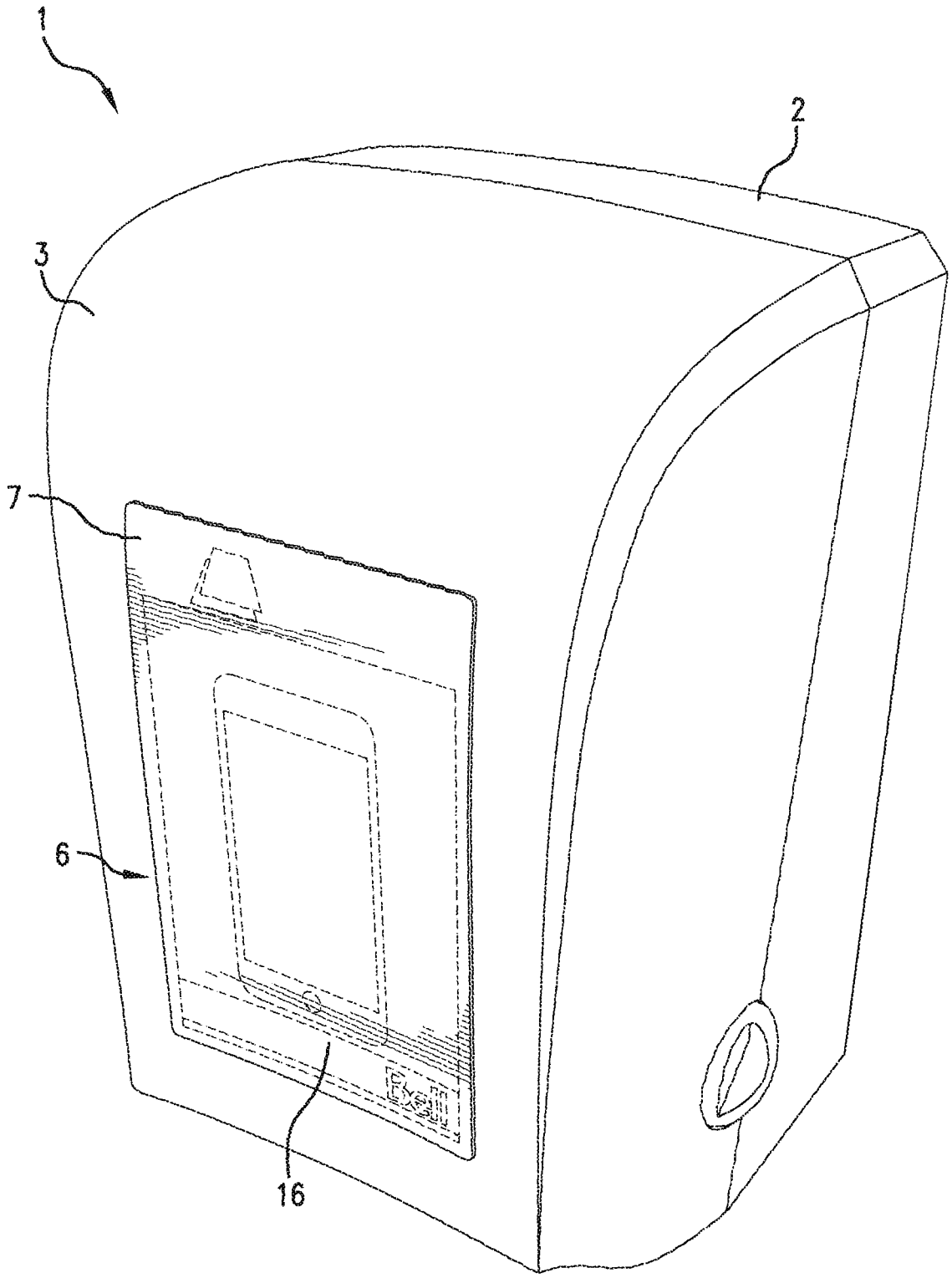
FIG. 1 is a perspective view of one embodiment of the product dispenser of the present invention, being a paper towel dispenser in its assembled use position.

As outlined above, the general focus of the present invention is to provide an enhanced product dispenser with the ability to display active visual content to nearby viewers. The display of active or dynamic visual content, using cost-effective display equipment or hardware that does not require a substantial installation burden, potentially enhances the revenue outcomes for advertisers while minimizing required cost and resources to install or maintain such equipment.

In addition to a product dispenser which includes the removable visual display module at the time of installation, there is also disclosed herein a retrofit product approach, which effectively would comprise the manufacture of a replacement dispenser cover for installation onto pre-existing product dispensers which would allow for the attachment of the visual display module of the present invention.

A method of use of the equipment of the present invention will allow for the display of active visual content and venues potentially without any cost for equipment installation or retrofit being incurred by the operator of the venue.

Product Dispensers:

As will be understood from a review of the specification herein, the intended scope and operability of the present invention is to provide the ability to provide active visual content for display to viewers in proximity to product dispensers of many types. It is specifically contemplated that this could be useful in the field of cleaning or hygiene product dispensers, including paper dispensers for folded or rolled paper products, liquid dispensers for useful soap or the like, or other types of product dispensers which might be located in a large number of public facilities. the examples of the applicability of the present invention which are outlined herein pertain specifically to paper or liquid dispensers, but it will be understood that the invention could be practiced in the context of any possible product dispenser which had a sufficient user-facing surface to permit the incorporation of a visual display module therein, and it will be understood to those skilled in the art of all such dispensers and all such approaches are contemplated within the scope of the present invention.

Active Visual Content:

The context of the phrase "active visual content" as used herein is intended to indicate any type of visual content which can visibly be altered during the course of its viewing by a viewer. The intended benefit of the present invention is that a product dispenser which is outfitted with an active media display system such as that outlined herein will be far cheaper to produce than one which includes a complete electronic computer display such as a tablet, computer monitor or the like. It is specifically contemplated that the active media surface and related components of the system of the present invention could comprise an "electronic paper" display such as those now known in the art—this represents a significant technical enhancement and cost efficiency in the manufacture of an active media display surface such as is outlined herein, over the prior art which would comprise the use of full tablet computer devices or similar monitors or panels. Where and electronic paper module was used, the active visual content which might be displayed would be a translucent active media surface which had visual content printed or otherwise displayed thereon which could again in conjunction with a power source and a controller have different sections which would light up on a time basis or otherwise—for example there might be a plurality of different regions of the active media surface which it was desired to light up in sequence and those could be individually illuminated either by LEDs or other lights placed there behind, or in certain circumstances it is also contemplated that the active media surface might comprise an electronic paper surface which had certain areas which can be illuminated as desired, or the entirety of the electronic paper surface could be repurposed with a new image or message from time to time.

Any type of a visual content display which was interactive or dynamic in any way, meaning that it was not simply static and did not remain constant without any change in behaviour or visual appearance is contemplated within the scope of active visual content, and all such approaches will be understood to be contemplated within the scope of the present invention. An "electronic paper" module or similar lower cost electronic module or something similar to this may be desirable over for example a tablet computing device or the like, for the purpose of maintaining a lower cost of manufacture.

Using a lower cost electronic module to provide dynamic or active visual content would also enhance the ability of the advertising provider or the venue operator to customize individual dispensers with individualized or more granular visual content. Some visual display modules would allow for simple replacement of the content thereon, either by reprogramming the controller associated with the module to display new content or in some cases replacing the active media surface with an active media surface that contains a revised refreshed advertising message or messages for active or rotating display.

Product Overview:

The first aspect of the present invention is a product dispenser for the dispensing of a product, which will display active visual content to nearby viewers during its availability for product distribution. FIGS. 1 through 4 shown one embodiment of the product dispenser 1 of the present invention. In the case of the product dispenser 1 shown in FIG. 1, it is a dispenser for roll paper towels, but as outlined elsewhere herein the product dispenser 1 could comprise a dispenser of one or more products of many kinds.

The product dispenser 1 comprises a dispensing mechanism 2 and a dispenser cover 3. The dispensing mechanism 2 is the holder and dispenser of a product which in this case is a roll 4 of paper products.

In addition to the dispensing mechanism 2, the primary aspect of the product dispenser 1 for the delivery of the added advertising functionality is related to the dispenser cover 3. The dispenser cover 3 is a cover which attaches to the remainder of the product dispenser 1 and covers the dispensing mechanism 2, providing the exterior aesthetic appearance of the product dispenser 1 along with covering for safety and noninterference purposes the dispensing mechanism 2 and the product 4 contained therein. Dependent upon many aspects of the product dispenser 1 itself, the dispenser cover 3 might be integrated with the remainder of the product dispenser 1 and fixedly or permanently attached to the dispensing mechanism 2, or as shown in the embodiment of FIGS. 1 through 4 the dispenser cover 3 can also be a removable or a line of cover which can be shifted from a normal use position into an open loading position etc. Any product dispenser that otherwise satisfies the general technical requirements outlined herein i.e. a dispenser for use in the dispensing of a liquid or paper or other hygiene product etc. which includes a cover 3 over a dispensing mechanism 2 will be understood to be within the scope of the present invention.

The dispenser cover 3 when attached in position to the remainder of the product dispenser 1 covers the dispensing mechanism 2 and any product 4 contained therein. The dispenser cover 3 has a user-facing surface 5 which faces outwards from the wall mount or the wall to which the product dispenser 1 might be mounted, in the case of the product dispenser 1 being wall mounted. The user-facing surface 5 is the surface on which the active visual content will be displayed, by incorporation of the visual display module 6 thereon.

Shown next in this embodiment is a visual display module 6 which will display the active visual content of the method and invention to nearby viewers. Sample active visual content 16 is shown on the active media surface 7 demonstrated in these Figures although the specifics of the content which would be displayed will obviously be infinitely variable and could be configured for use in a customized way by location for example—to tailor the advertising or other media to be displayed for the maximum benefit for use in the intended use location of the dispenser 1 itself. The visual display module 6 mounts on or into the user-facing surface 5 of the dispenser cover 3 to display active visual content. The visual display module 6 has an active media surface 7 which is the surface on which visual content will be attached or displayed. In the embodiment shown in FIG. 1 through 4, the visual display module 6 is rectangular in shape, and is attached to the outer surface of the dispenser cover 3.

Figure 3:
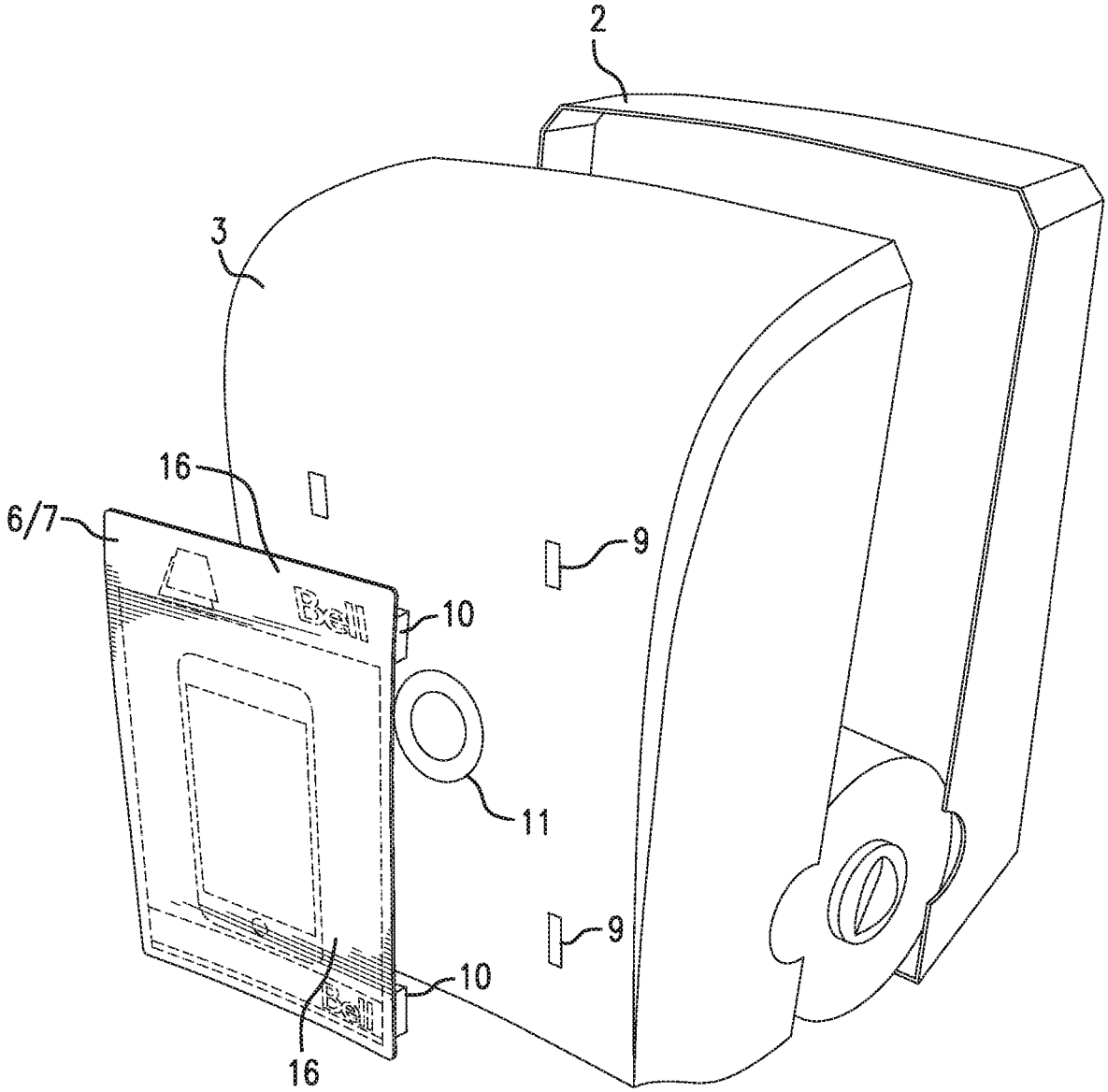
FIG. 3 is an exploded view of the product dispenser of FIG. 1, showing the component parts thereof.

FIG. 3 in particular in exploded view shows retaining means for attachment of the visual display module 6 to the user-facing surface 5 which comprises at least one engaging slot 9 on the user-facing surface 5 of the dispenser cover 3, and corresponding bendable retaining tabs 10 on the rear of the visual display module 6 to snap into position in the at least one engaging slot 9. The at least one engaging slot 9 and corresponding bendable retaining tab 10 shown in this Figure will be understood to only be one of a large number of different types of releasable retaining means which could be designed for use in accordance with the remainder of the present invention, all of which are contemplated within the scope hereof.

Figure 4:
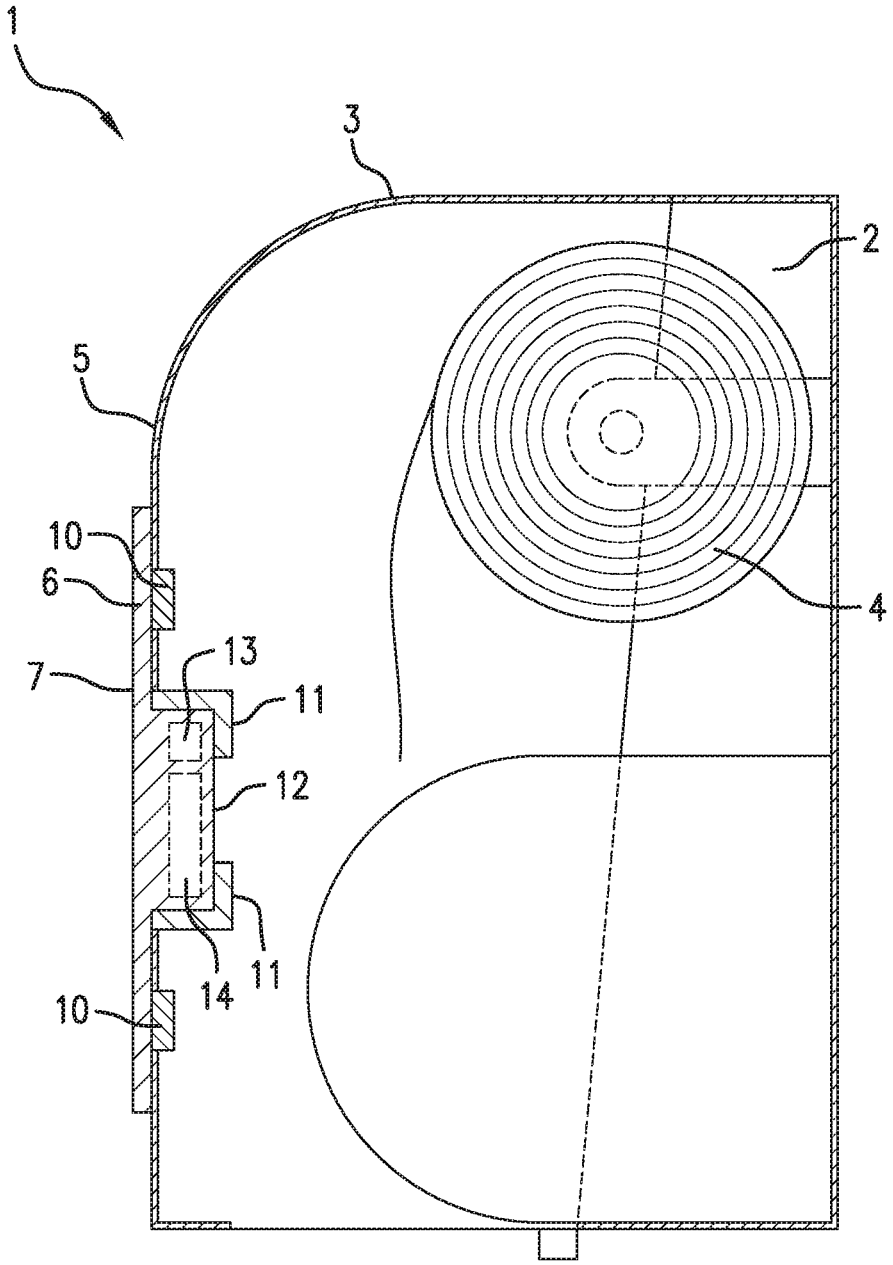
FIG. 4 is a cutaway side view of FIG. 1, showing the planar positioning of the user-facing surface and the active media surface.

In the embodiment of FIGS. 1 through 4, there is a support flange 11 in an open aperture in the user-facing surface 5 of the dispenser cover 3, which support flange 11 can engage the rearward surface 12 of the visual display module 6 to hold it in place in relation to the user-facing surface 5 and the dispenser cover 3. In this particular embodiment the visual display module 6 is surface mounted to the user-facing surface 5, resulting in some thickness of the visual display module 6 protruding in front of the user-facing surface 5. FIG. 4 shows the relative relationship and the projection of the forward active media surface 7 in front of the user-facing surface 5. In other cases and other embodiments, as will be outlined in further detail below, a module recess can be used so that the user-facing surface 5 and the active media surface 7 are closer to flush to each other.

In operation of this embodiment, the product dispenser 1 could be approached and used by a user to dispense and obtain product 4, and the visual display module 6 would display the predetermined active visual content on the active media surface 7 during dispensing or during the idle time of availability of the product dispenser 1. If it was necessary at any point to change the visual content on the active media surface 7, or otherwise remove or repair the visual display module 6, the retaining means could be released to allow for removal, repair and replacement of the visual display module 6. The active media surface 7 would "activate" the media 16 displayed thereon by intermittently altering the appearance of the media on the active media surface 7. Also shown in dotted relief in FIG. 4 is a controller 13 and the power source 14 integrated within the module 6 this will be outlined in further detail elsewhere below and any number of different types of controllers 13 or power sources 14 are again contemplated within the scope of the present invention.

The visual display module 6 might constantly display the media 16 on the active media surface 7 in its active fashion i.e. the controller 13 might always be activated, or in other embodiments, the module 6 might include proximity sensors, timers or other circuits for controls which would allow forward the modification of the behaviour of the module 6 and the display of the active media service 7 based upon time of day, proximity of individuals to the dispenser 1 etc. Again all such approaches are contemplated within the scope of the present invention.

Figure 2:
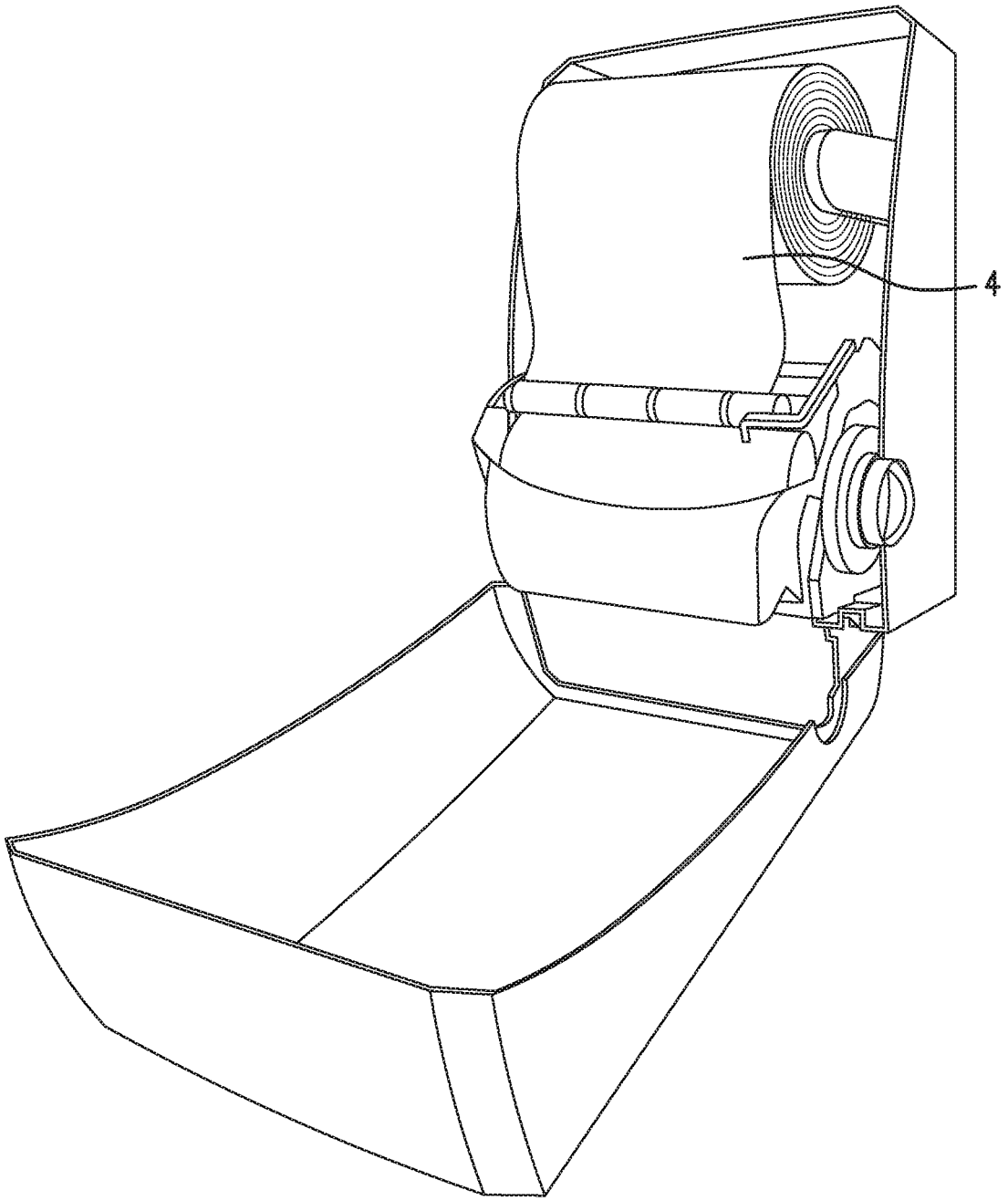
FIG. 2 is a perspective view of the product dispenser of FIG. 1 with the dispenser cover open, to demonstrate other components of the dispenser.

FIG. 1 shows the product dispenser 1 in a closed and dispensing position, whereas FIG. 2 demonstrates, with respect to this particular type and configuration of a product dispenser 1, the dispenser cover 3 being a hinged open position for the purpose of accessing the equipment stored within the dispenser 1 it will be understood that many different types of product dispenser 1 might include hinges or other means of attachment of the product dispenser cover 3 if the cover 3 could be opened, and all such approaches are contemplated within the scope of the present invention. Similarly, in other cases where the cover 3 was integrated or unitary with the remainder of the dispenser 1 and could not be opened, it will be understood that those types of embodiments of product dispensers 1 are also contemplated within the scope of the present invention in so far as the incorporation of a visual display module 6 therein and to achieve the active media display aspect of the invention could still be implemented.

FIG. 3 demonstrates the key components of the embodiment of FIGS. 1 and 2 in exploded relation, simply to understand the compilation or assembly of the key components of the dispenser 1. The cutaway side view of FIG. 4 is intended to show the relation and attachment of the key components of the dispenser 1 of these Figures, in their attached and operational position.

The dispenser 1 of FIG. 1 would be operated by its mounting to a wall or other surface in a used location—this particular dispenser 1 being a paper towel dispenser it might be mounted in the kitchen, washroom or the like—and the controller 13 and the remainder of the visual display module 6 will activate/alternate/animate the content appearing on the active media surface 7. People approaching the dispenser 1 to obtain paper towels, or whatever product is dispensed by the particular dispenser 1 in question—would be engaged by the active media content 16 displayed on the active media surface 7. The visual display module 6 integrated into the product dispenser 1 provides a cost-effective means of visual engagement of individuals in proximity to the dispenser 1—it is contemplated that the actual content on the active media surface 7 might be in addition to being customized for the location, replaceable from time to time either by requirements of replacement of a portion of the module 6, or in other cases the controller 13 activating an electronic paper display might have multiple content displays stored therein which could simply be electronically rotated. Both such approaches, to alternating the content on the surface 7 from time to time, either by way of a physical replacement or a electronic display approach, are contemplated within the scope of the present invention.

Figure 5:
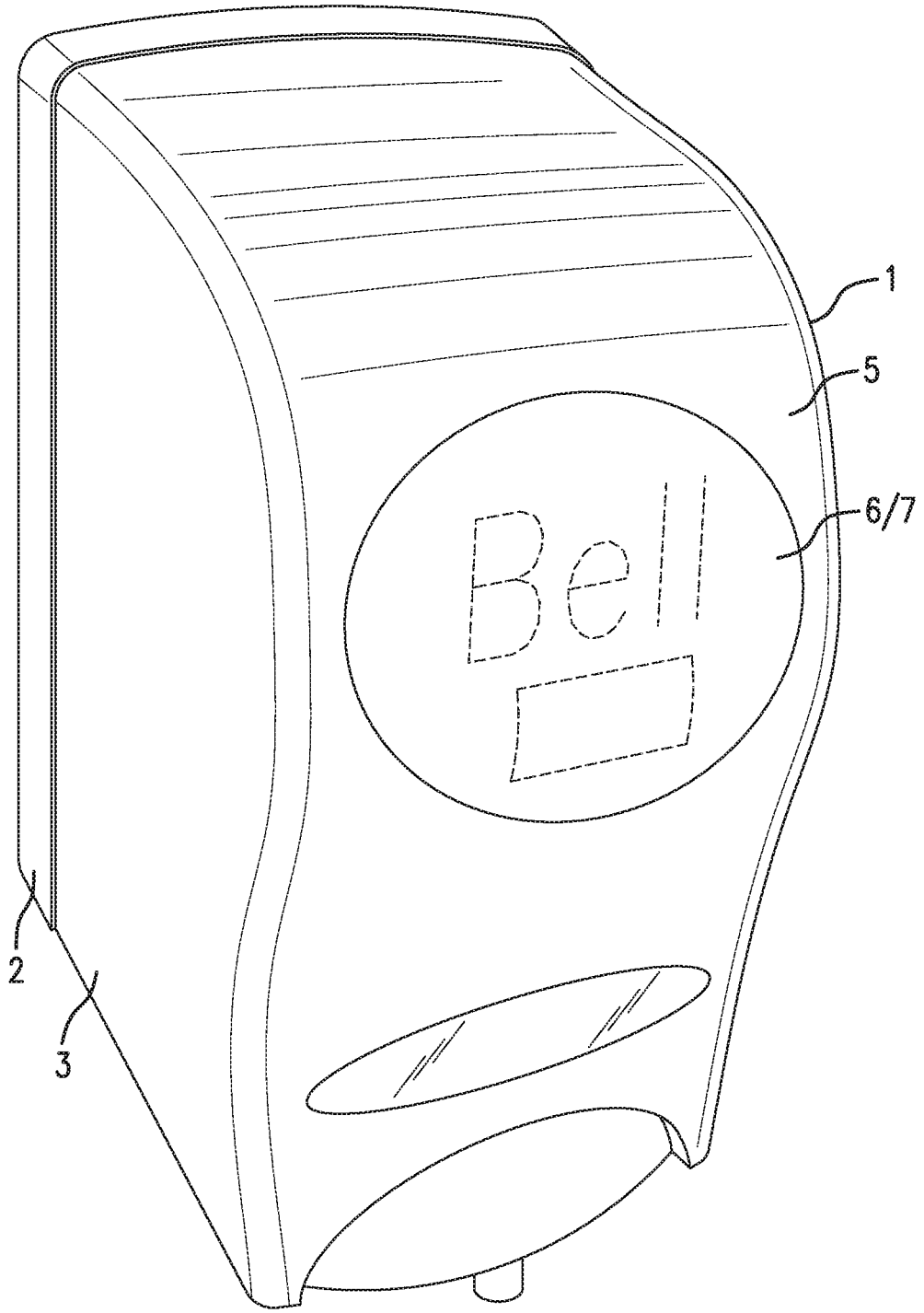
FIG. 5 is a perspective view of an alternate embodiment of a product dispenser in accordance with the present invention, the product dispenser being a liquid dispenser.
Figure 6:
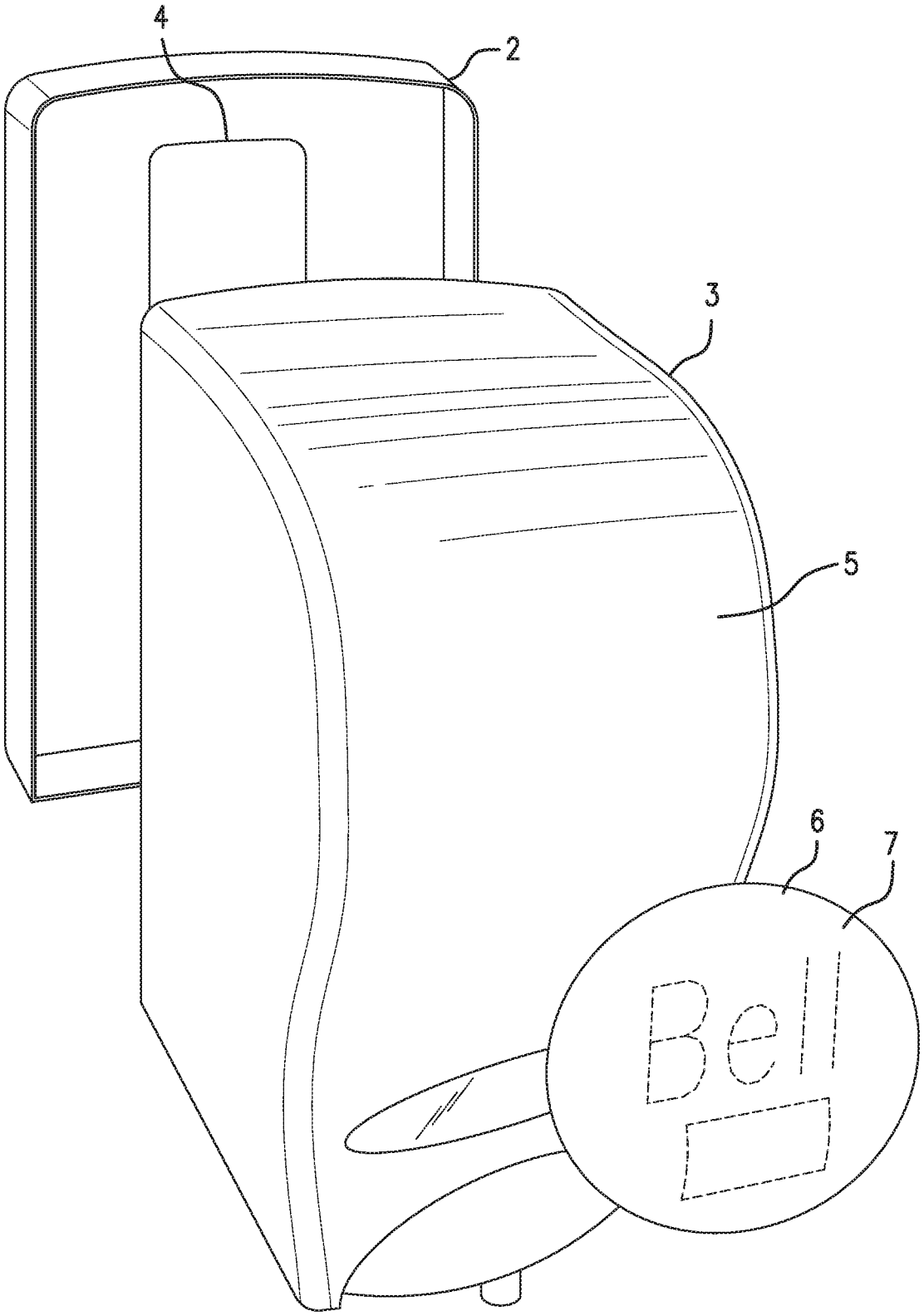
FIG. 6 is an exploded view of the product dispenser of FIG. 5, showing the component parts thereof.

Referring next to FIG. 5 and FIG. 6 there is shown an alternate embodiment of product dispenser 1 in accordance with the present invention, in which the visual display module 6 is round rather than rectangular—this particular product dispenser 1 is a liquid product dispenser, so that the dispensing mechanism 2 would be a reservoir and valve for the disbursement of liquid product 4. As in the case of the other embodiments outlined herein the visual display module 6 would include the necessary power source and electronic controller to interact and provide the active visual content via the active media surface 7.

In the embodiment of FIGS. 5 and 6, the user facing surface 5 and the active media surface 7 are approximately flush or coplanar. Both for cosmetic or functional hygienic purposes it may be desired that the user facing surface 5 and the active media surface 7 be closer to flush, or alternatively be set apart further from each other in definition as in the embodiment of FIGS. 1 through 4—any such approach is contemplated within the scope of the present invention and obviously the dispenser cover 3 could be modified in terms of the mounting and attachment of the module 6 to accomplish either such approach.

Dispenser:

One of the key components of the product dispenser 1 of the present invention is a dispensing mechanism 2, which is responsible for the dispensing of product 4 by the product dispenser 1. The dispensing mechanism 2 typically comprises the substructure or frame of the product dispenser 1, along with the necessary holder or hardware to engage, retain and dispense the product from within the remainder of the dispenser 1.

For example if the product dispenser 1 was a paper towel dispenser for roll paper towels, the dispensing mechanism 2 would be the necessary holder and rolling and cutting apparatus to dispense paper towels through an external aperture on the product dispenser 1. In other cases where the product dispensed was a folded physical product, there are other types of dispensing mechanisms which can be used to dispense the folded product. In still other cases a liquid product could be dispensed from a dispensing mechanism comprising a tank or reservoir of some kind with a valve, and that product may or may not be under pressure within the reservoir. Any number of different types of products can be distributed from a particular product dispenser 1 and dispensing mechanism 2 and any type of a product dispenser 1 which would be used in an environment in which the active visual content method of the present invention would be desired to be practiced is contemplated within the scope of the present invention.

Visual Display Module:

The next element of the invention to be discussed in detail is the visual display module 6. The visual display module 6 is the core component of the combined product dispenser 1 of the present invention, as well as forming the subject matter of a subset of the claims herein. The visual display module 6 of the present invention could also be provided on a freestanding basis to retrofit product dispensers 1 with the ability to provide an active media display in accordance with the remainder of the present invention in the visual display module 6 is intended to be encompassed by the claims of this application on a freestanding basis as well as as an integrated component of the product dispenser 1 or a dispenser cover 3.

Figure 7:
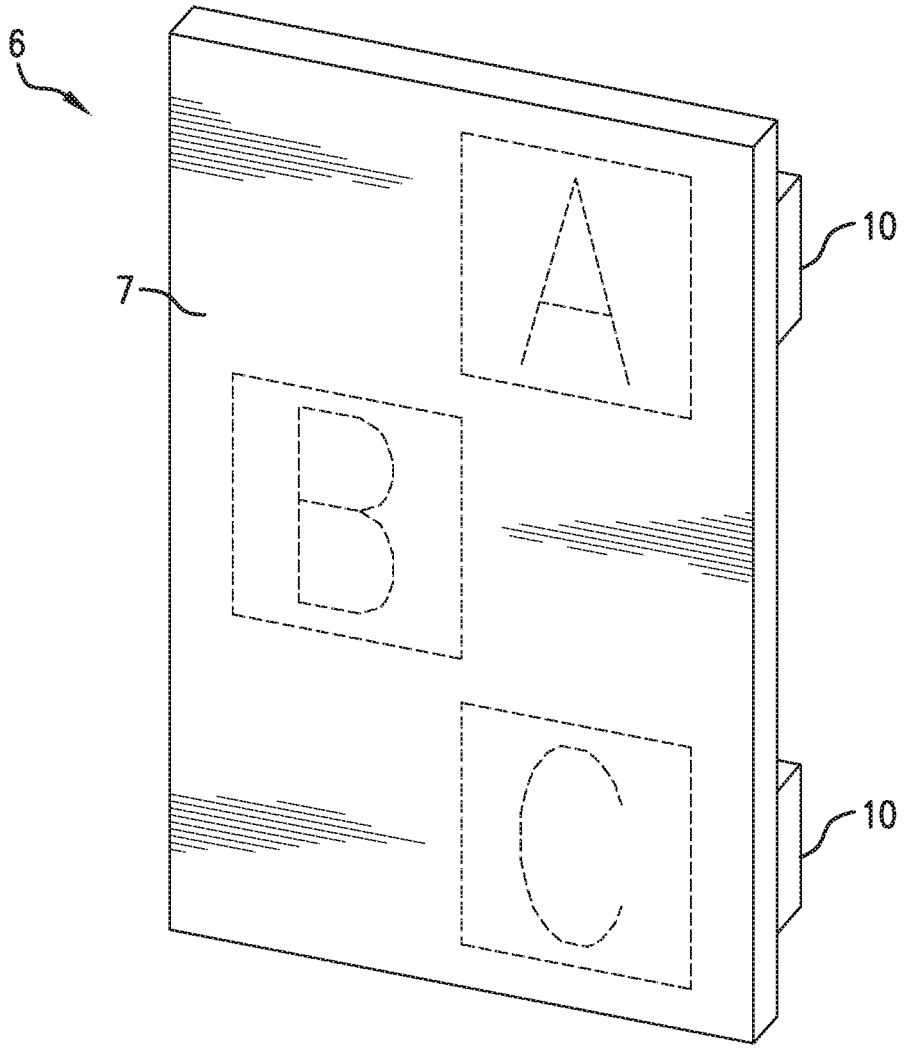
FIG. 7 is a front perspective view of one embodiment of a visual display module in accordance with the present invention.

Referring first to FIG. 7 there is shown a perspective front view of one visual display module 6 in accordance with the present invention—the visual display module 6 shown in this Figure is rectangular in outer circumference of the active media surface 7, similar to the product dispenser 1 shown in FIGS. 1 through 4. It will be understood however that the active media surface 7 could have any number of different shapes without departing from the intended scope of the present invention.

Figure 8:
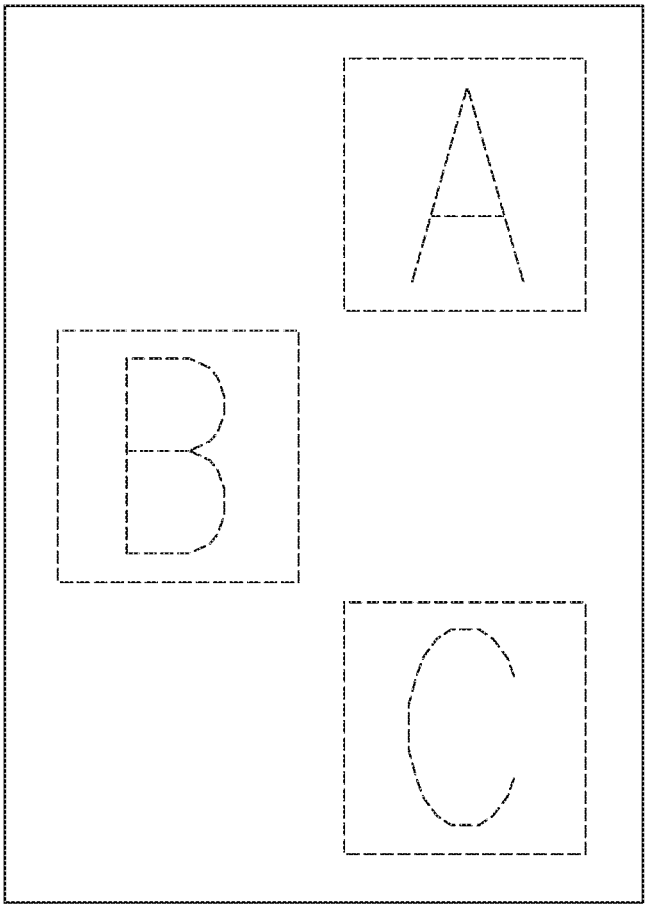
FIG. 8 is a front view of the visual display module of FIG. 7.

Shown on the active media surface 7 of the module 6 demonstrated in FIG. 7, purely for demonstrative purposes, are three dotted relief media zones 16—this is intended to simply signify or show the different active media areas or active media content components which would be displayed on the active media service 7 during the active media method operation of the present invention. For example the controller of the module 6 could either in sequence or in aggregate activate or illuminate the different media zones on the surface 7. Also shown in the embodiment of FIG. 7 are retaining tabs 10, similar to those shown in the visual display module 6 incorporated into the dispenser 1 shown in FIG. 1 through 4, for the purpose of retaining the module 6 in place on the user facing surface of a dispenser cover. FIG. 8 is a front view of the module 6 of FIG. 7.

Figure 9:
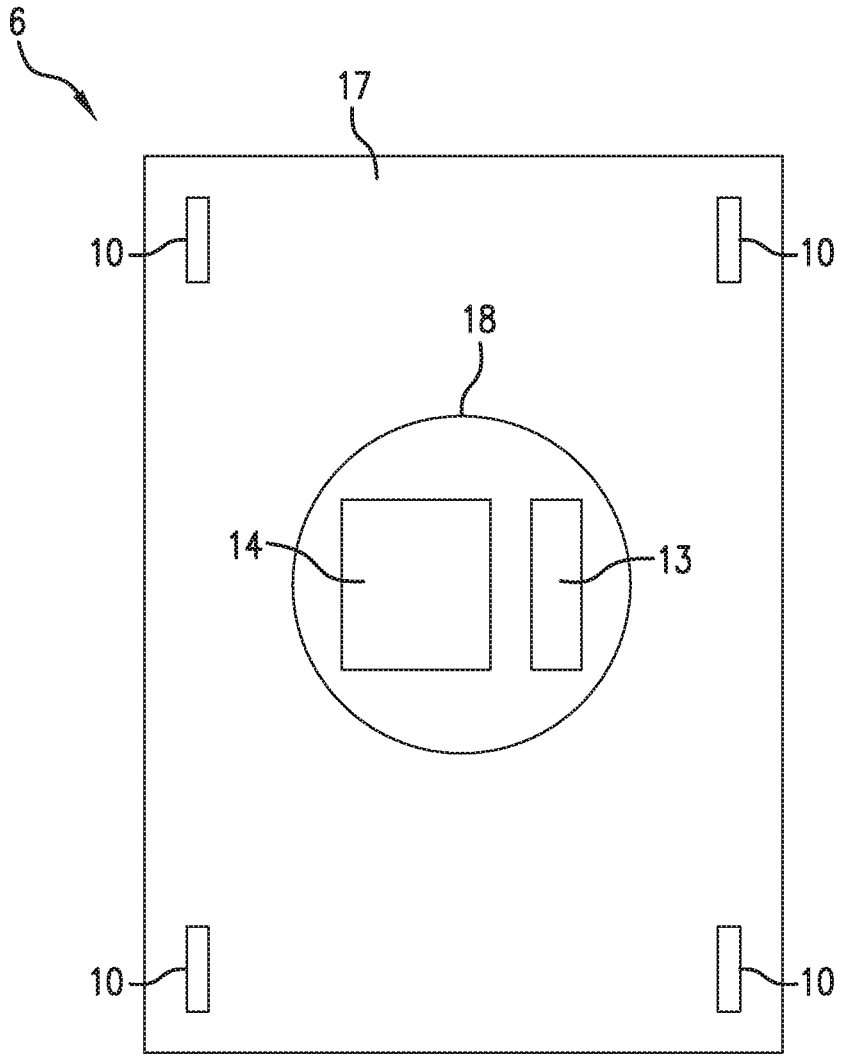
FIG. 9 is a rear view of the visual display module of FIG. 7.

Referring to FIG. 9 there is shown a rear view of the visual display module 6 of FIG. 7. The rear surface 17 of the module 6 is shown. Also shown is a housing 18 extending rearward from the rear surface 17 of the module 6 which contains the controller 13 and the power source 14—which could be a battery or other type of power source operatively connected to the necessary electronic circuitry to activate the media display by the active media surface 7 in cases where the module 6 was to be recessed such that the active media service 7 was approximately flush with the user surface of the dispenser cover to which it was attached, the rear surface 17 in the housing 18 would be recessed into the user facing surface of the dispenser cover. In other cases, such as that shown in FIG. 1 et al., where the visual display module 6 is placed on the user facing surface 5 of the dispenser cover 3, the rearward surface 17 of the module 6 could engage the user facing surface 5 of the dispenser cover 3 with the housing 18 being recessed therein. In some embodiments, a housing 18 which contained the power source 14 and the controller 13 could be round as is shown here, and in other cases the housing 18 could be larger or smaller depending upon the nature and size of the components to be contained and the desired method of attachment. In still other cases, the controller 13 of the power source 14 might actually be contained within a physically separate module which would be included inside of the dispenser cover 3 or elsewhere and could simply be cabled or connected to the active media surface 7—that type of an approach is also contemplated within the scope here of although not being shown.

Figure 10:
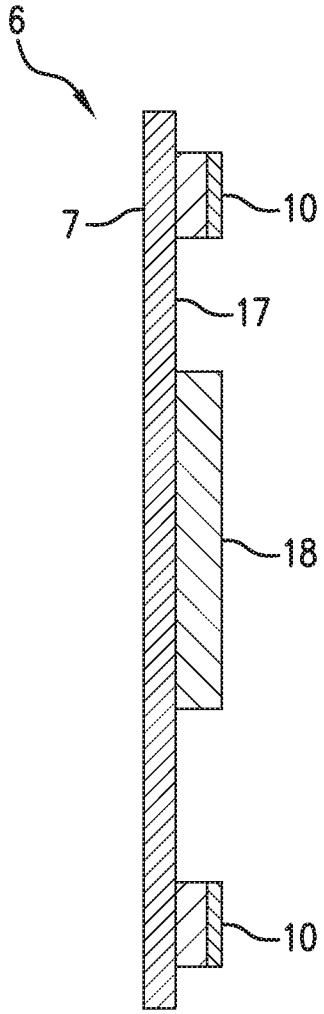
FIG. 10 is a cutaway side view of the visual display module of FIG. 7.

FIG. 10 is a cutaway side view of the visual display module 6 of FIGS. 7 through 9, demonstrating the configuration of the components thereof in relation to each other and in relation to the rear surface 17 of the module 6 which would in many cases engage the user facing surface of the dispenser cover of a product dispenser used in accordance with the remainder of the present invention.

In cases where the dispenser cover of the product dispenser to which the module 6 will be attached, the product dispenser cover might include a recess or an aperture through which the housing 18 could extend for the purpose of providing the optimal flush mounting configuration. The recess provided in the user facing surface of the dispenser cover to accommodate the placement of the housing 18 therein could have a coordinating inner circumference, to approximate the outer circumference of the housing 18. Any number of different configurations in this regard will be understood to those skilled in the art and are all contemplated within the scope of the present invention insofar as they do not depart from the desired result which is to provide for an approximately flush mounted visual display module 6 on a dispenser cover of a product dispenser.

The visual display module 6 is capable of displaying active visual content to a viewer. The concept of active visual content is discussed in further detail elsewhere herein—generally speaking the visual display module 6 will be capable of providing some changing visual indication of the visual content contained upon its active media surface 7 during operation (likely as an electronic paper module or similar approach). The active nature of the visual media display which will be provided to proximate individuals could be anything from the provision of fully electronically animated content, through to in a more basic embodiment selective illumination of multiple illumination zones on an LED panel or the like which provided for same. It is really contemplated that any type of an activation of the active media surface 7 which would accomplish the objective of catching the eye of an individual in proximity to the product dispenser 1 is contemplated within the scope of activation and active media content display and any such content display that accomplishes this objective within the framework of the remainder of the invention as outlined herein is contemplated within the scope of the present invention.

It is particularly and explicitly contemplated that the visual display module 6, including the controller 13, the power source 14 and the active media surface 7, could comprise any number of types of lower cost basic electronic display devices which would significantly reduce the cost comparison to the use of tablet computers, full computer screens or the like. This would make it more affordable for people to adopt an advertising method as outlined herein, particularly given that many of these dispensers are used in washrooms or other less than hygienic locations where they may be exposed to significant ongoing stress and both from the purpose of minimizing the installation cost as well as minimizing maintenance cost it would be desirable to provide this type of an approach—provision of the visual display module 6 of the nature outlined herein which is a reasonable cost alternative to a full-blown computer implementation really is considered by the inventors to not only formed the core of the present invention but also to be the basis on which this type of a method will substantially and significantly rollout into industry. When it was required to repair the visual display module 6—for example to replace a battery power source 14 or otherwise, or to change the visual content 704 on the active media surface 7, the visual display module 6 could be removed from the dispenser cover 3 for this purpose, and then reinstalled.

Figure 11A:
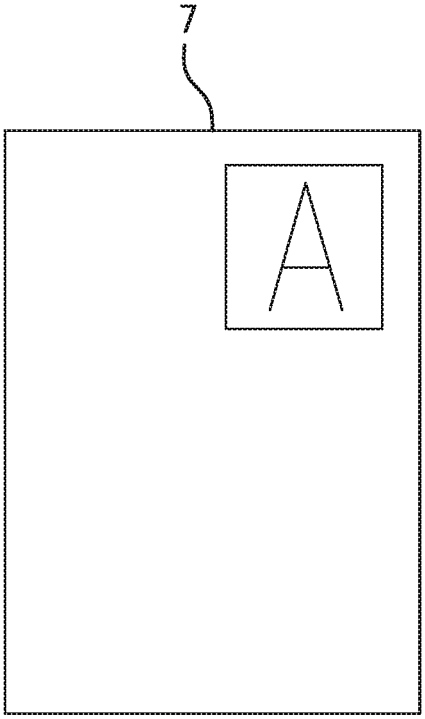
FIGS. 11A through 11D demonstrate active media display indications on the visual display module of FIG. 7.
Figure 11B:
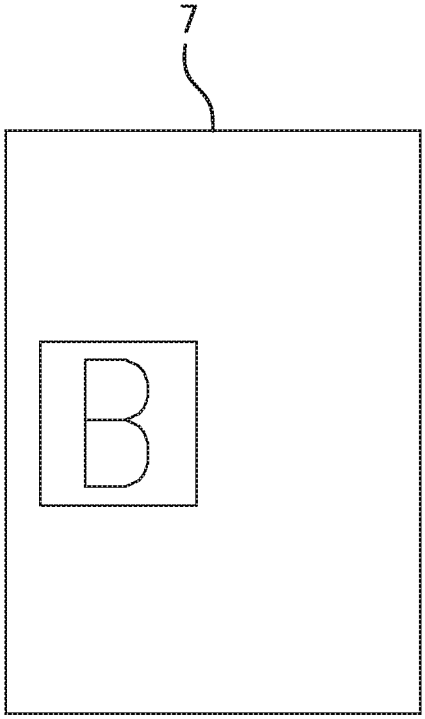
Figure 11C:
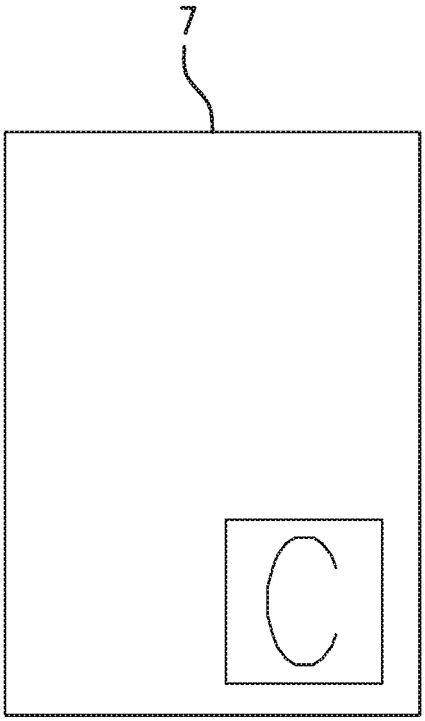
Figure 11D:
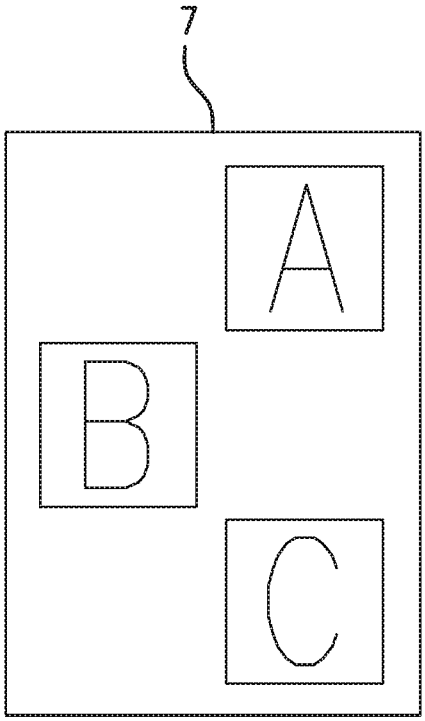

The embodiment shown in these Figures includes a controller 13 and a power source 14 which in the context of an electronic paper module or similar display the controller 13 and the power source 14 could work in conjunction with the active media surface 7 to provide the active visual content when in operation. In some embodiments, the visual content 16 could be a translucent applique which could be attached to the active media surface 7 and the active media surface 7 might be divided into a plurality of lit zones, such that the visual display module 6 could animate or activate the visual content 16 by lighting up certain zones of the active media surface 7 therebehind to cause certain of the zones and related portions of the visual content 704 to become illuminated. FIGS. 11A through 11D are provided to demonstrate one potential visual progression of the active media content 16 on the surface 7 as might be activated by a controller 13 etc. These Figures demonstrate the progressive activation or visualization of three different zones on the active media surface 7, as first demonstrated in dotted relief on FIG. 7. The controller 13 might activate the visual content lettered as A, B and C in progression, as shown, or might alternatively illuminate statically or in an on-and-off flashing manner for example all of the zones at the same time as shown in FIG. 11D. These Figures are really intended just to show a couple of different options as to how the visual media content might be actively displayed in accordance with the present invention but it will be understood that they are not to be considered as limiting or exhaustive in any way. Any type of added display hardware and software combination resulting in the ability to provide any type of an active media display on the surface of the visual display module are all contemplated within the scope of the present invention.

Many types of active media surface 7 and related electronic components of the visual display module 6 can be contemplated and any approach which allows for a visual display module 6 which can be removably attached to a dispenser cover 3 of a product dispenser 1 to provide active visual content is contemplated within the scope of the present invention.

Media Ready Dispenser Cover:

In addition to the product dispenser 1 and the visual display module 6 which are shown in FIGS. 1 through 10 and the related claims to those aspects of the present invention there is also disclosed the media ready dispenser cover, for use either in OEM or retrofit applications to allow for the fit out of product dispensers for use in the active media display method outlined herein. The media ready dispenser cover of the present invention could be used with any product dispenser that had a removable or interchangeable dispenser cover there on the media ready dispenser cover of the present invention could be manufactured in varying shapes and sizes or with varying adapters to allow for its attachment to a product dispenser to retrofit or outfit a product dispenser for use along with a removable visual display module in accordance with the present invention.

The media ready dispenser cover of the present invention would be removably attachable to a product dispenser, so that it could be retrofitted or fitted onto a new dispenser, to enable the active media display method of the present invention to be used with a pre-existing dispenser or a dispenser which was otherwise not specifically manufactured for the purpose—it is specifically contemplated that a media ready dispenser cover which would allow for retrofitting of product dispensers to allow for the practice of the present invention by the attachment of Abe removable visual media display module 6 thereto forms a significant aspect of the equipment of the present invention.

A dispenser cover 3 which has retaining means to removably attach a visual display module 6 thereto onto a user facing surface 5 could be sold without the visual display module 6, with or without a cover attached in place of the visual display module 6, and could even be subsequently upgraded with the addition of a visual display module 6 in accordance with the remainder of the invention that is to say that the dispenser cover could be sold on a freestanding basis or could be integrated into product dispensers 1 otherwise being sold, without the visual display module 6 being attached, such that if a purchaser of product dispensers later wish to add the visual display module 6 that could be done. The sale of a product dispenser 1 which could be upgraded with the visual display module 6 could provide maximum customer flexibility, since while some customers purchasing a product dispenser 1 might not immediately require the active advertising method of the invention, by selling them a product dispenser 1 with dispenser cover 3 capable of subsequently accepting the attachment of a visual display module 6 maximum flexibility is achieved, and the manufacture of the dispenser cover 3 with retaining means thereon would not significantly impact manufacturing cost.

Figure 12:
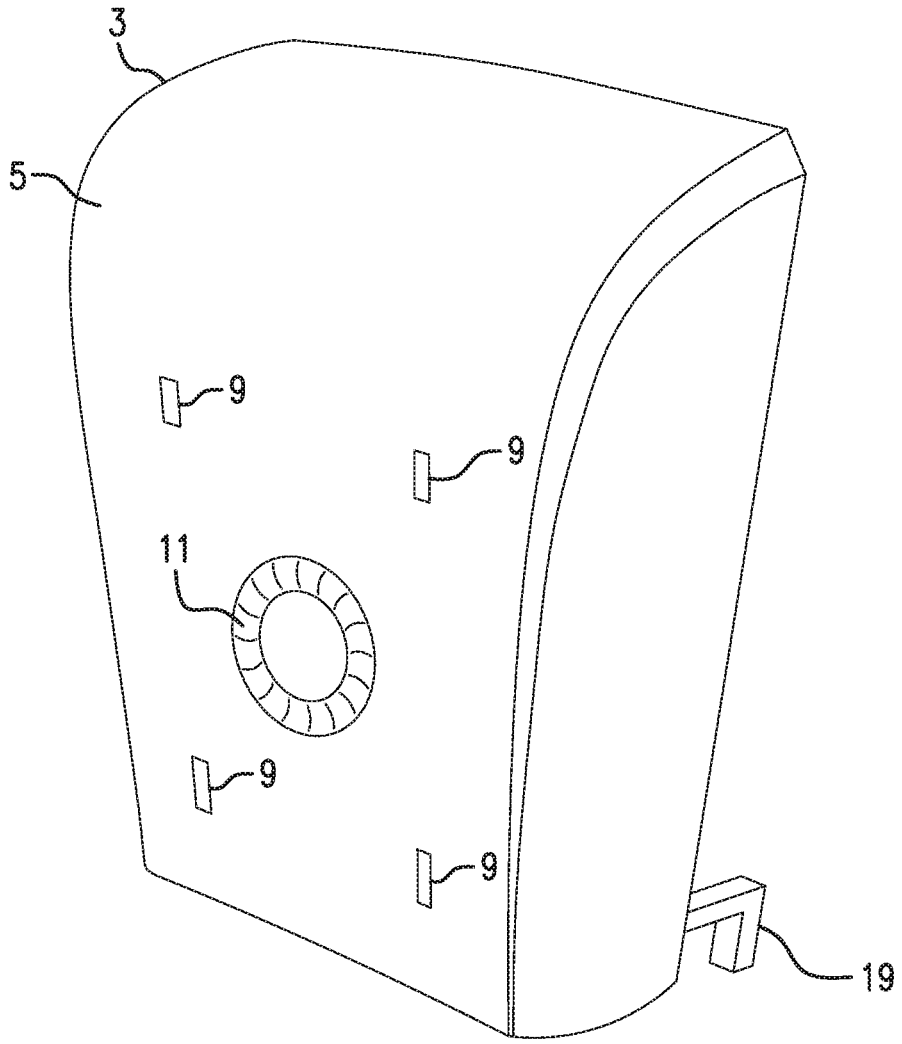
FIG. 12 is a front perspective view of one embodiment of a dispenser cover in accordance with the present invention, with a module recess therein.

FIG. 12 shows a front perspective view of one embodiment of a media ready dispenser cover 3 in accordance with the present invention which could be used on a pre-existing product dispenser which was not manufactured with the capability of attachment of the visual display module 6 in accordance with the remainder of the present invention thereto. For the purpose of homogeneity and flow in the remainder of the patent specification, the media ready dispenser cover 3 shown in this figure is a media ready dispenser cover 3 detached from the overall product dispenser shown in FIG. 1. It is of the same shape and size for the purpose of explaining the content of the invention that will be understood to those skilled in the art of design of these types of products that virtually any shape and size of a dispenser cover 3 could be manufactured with appropriate hardware or adapters for attachment thereof to a product dispenser without in any way departing from the intended scope of the present invention.

The embodiment of the media ready dispenser cover 3 shown in FIG. 12 shows the removable attachment means for the attachment of a module 6 although the module 6 is not attached in this figure. In this case the removable attachment means 9 for engagement of the visual display module comprise a plurality of slots in the user facing surface 5 through which coordinating tabs from the module 6 can extend to attached module. Also shown is a module recess 11 into which rearward hardware of the visual display module 6 can be recessed when attached.

A mounting hook 19 is shown in this Figure as well—this is the mounting hardware which would be used to attach the media ready dispenser cover 3 to a product dispenser. The mounting hook 19 will be understood to be really only one of literally limitless numbers of different types of hooks or hardware which could be used to render a media ready dispenser cover 3 in accordance with the remainder of the present invention attachable to a particular type of a product dispenser. The attachment hardware 19 could even be interchangeable such that different types of attachment hardware 19 could be provided for the interchangeable use of a single model of a media ready dispenser cover 3 with different types of dispensers.

Figure 13:
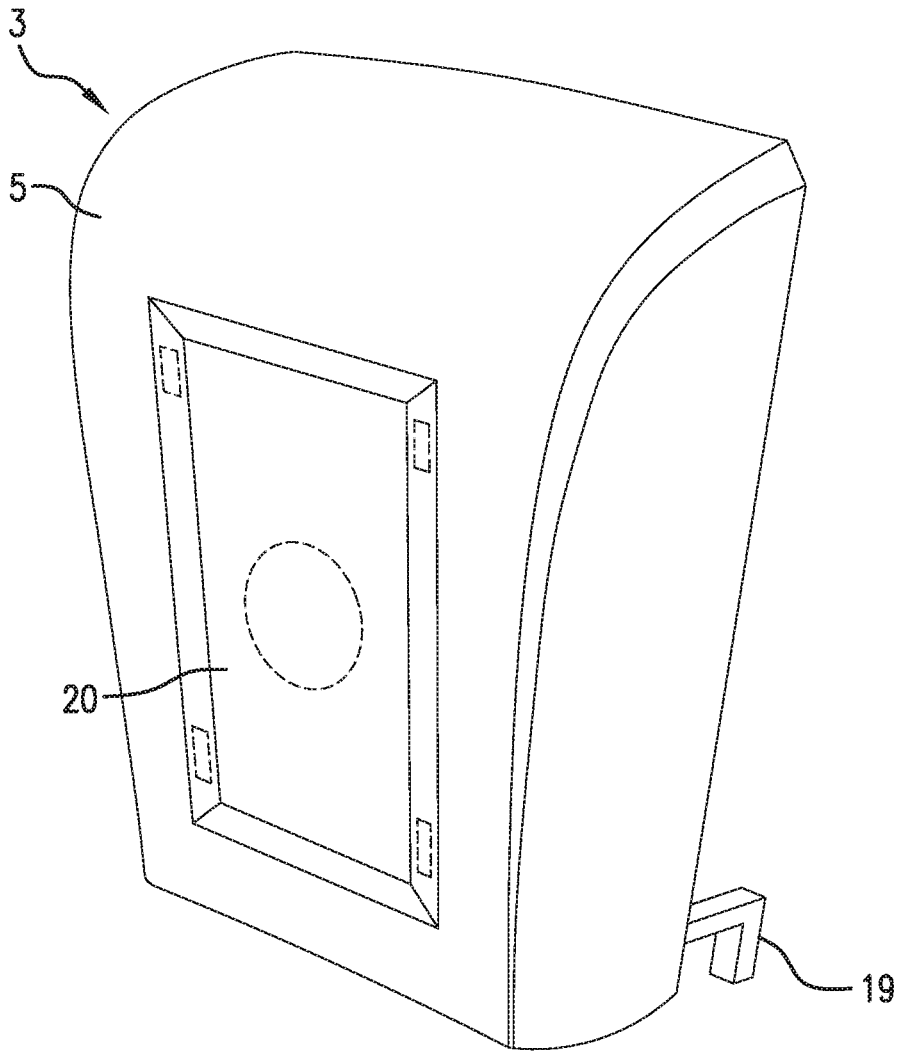
FIG. 13 is a front perspective view of the dispenser cover of FIG. 12, with a cover over the module recess.

Referring next to FIG. 13 there is shown a perspective view of the media ready dispenser cover 3 of FIG. 12 which has a removable cover 20 attached to the user facing surface 5 thereof, to obscure or cover the recess 11 and the attachment points 9—a media ready dispenser cover in accordance with this Figure could be sold preinstalled or on a retrofitted will basis for use of many different types of product dispensers and would allow for the subsequent removal of the removable cover 20 and replacement thereof with a visual display module 6.

Figure 14:
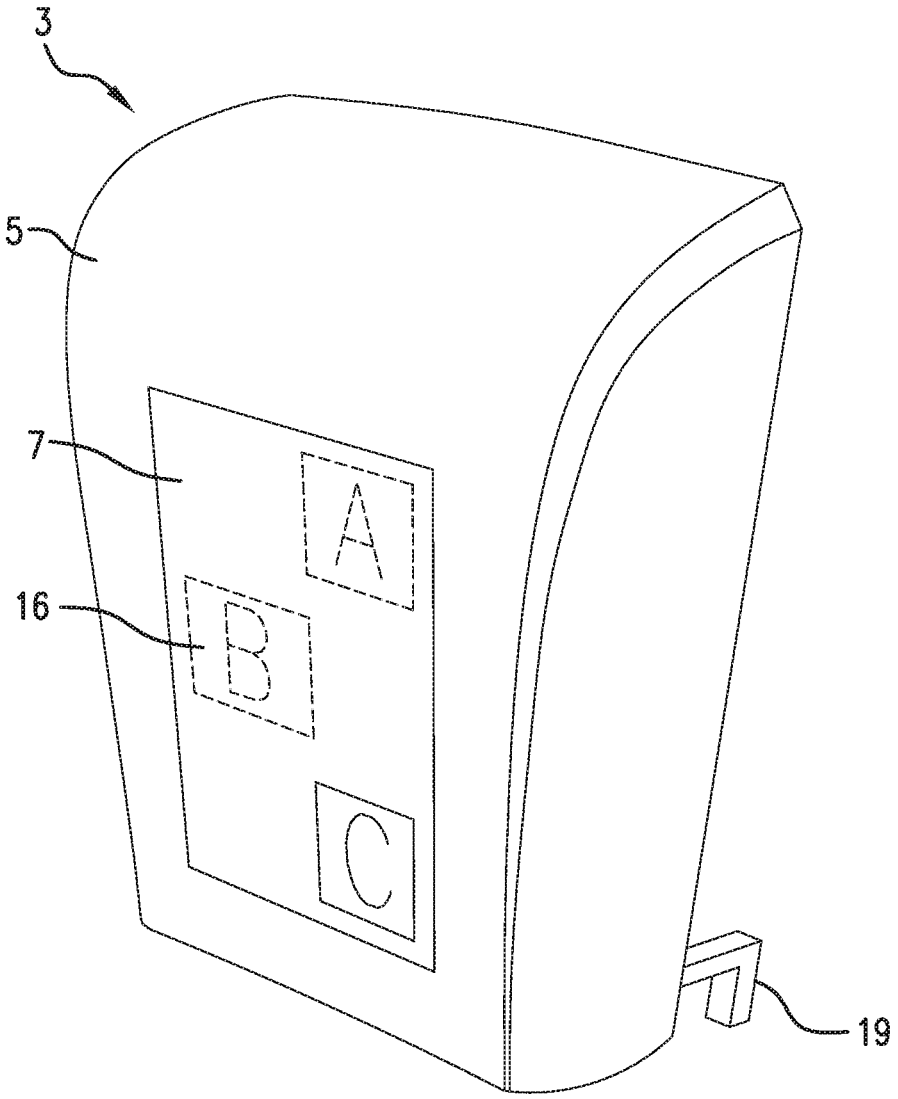
FIG. 14 is a front perspective view of the dispenser cover of FIG. 12, with a visual display module attached.

Referring next to the embodiment demonstrated in FIG. 14, there is shown another figure with a similar media ready dispenser cover 3 with the visual display module six similar to that shown in earlier Figures and narrative in this application for demonstrative purposes the active media service 7 and the media content itself 16 can be seen. Media content 16 comprising in this case three different media zones which could be illuminated or activated by the controller as required are shown, within this case one of the three active media content zones being actuated and the other two not being actuated, as they are shown in dotted relief.

Figure 15:
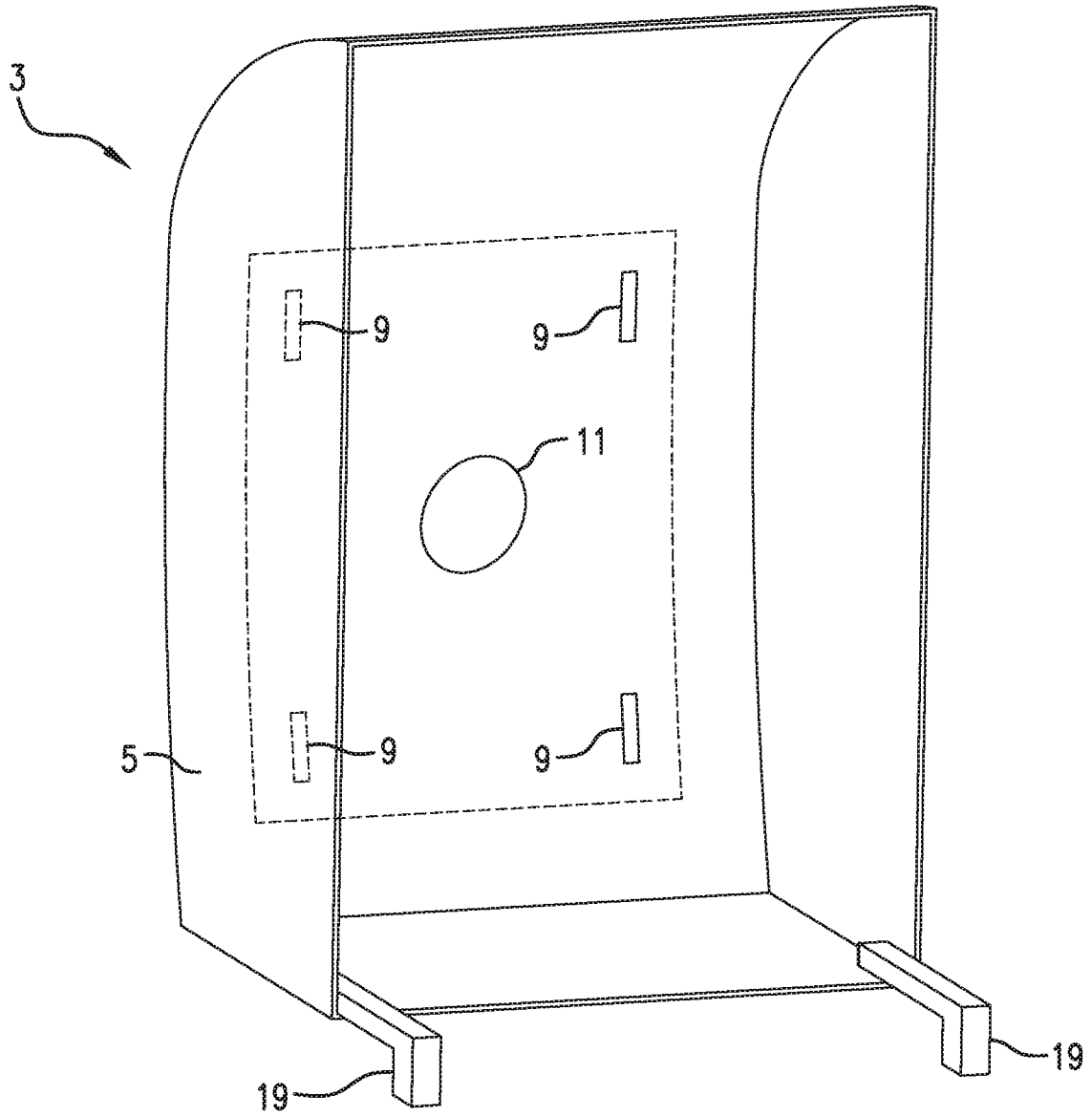
FIG. 15 is a rear perspective view of the dispenser cover of FIG. 12.

FIG. 15 shows an interior perspective view of the media ready dispenser cover 3 of FIGS. 12 through 14. The inside of the module recess 11 and the module attachment points 9 can be seen, and the rectangle shown in dotted relief in this figure demonstrates the positioning of the visual display module 6 on the outer user facing surface of the device.

As outlined in further detail elsewhere herein in certain embodiments of the media ready dispenser cover 3 with the visual display module 6 attached, the power pack and controller for the module 6 might be integrated there with such that they were recessed into the user facing surface 5 of the cover 3, or in other cases they might be mounted as a separate freestanding control module inside of the cover 3 and simply connected to the rear of the active media display surface 7. Both such approaches are contemplated within the scope of the present invention.

By manufacturing the dispenser cover 3 for after market attachment to a dispenser, the active advertising functionality of the present invention can be extended to a large quantity of pre-existing dispensers already in the marketplace. Dispensers could dispense one or more products—all such sizes of dispensers are contemplated within the scope of the present invention.

Retrofit Dispenser Cover:

It is explicitly contemplated that a dispenser cover in accordance with the present invention, including the visual display module 6 which would allow for the practice of the active media method outlined herein could be made available for sale on a retrofit basis, to allow for the retrofit of pre-existing product dispensers to practice the active advertising method outlined herein. A dispenser cover for use and attachment to a pre-existing product dispenser, which has a user facing surface accommodating and outward facing active media surface of the display module in accordance with the remainder of the present invention is explicitly contemplated to be within the scope of the present invention.

In addition to a complete product dispenser 1, it will also be understood that the present invention logically includes a retrofit option which can be used with pre-existing product dispensers, to deploy the method and methodology of the present invention in a widest possible selection of locations including those which already have pre-purchased or preinstalled product dispensers which it is desired to retrofit with the active visual content ability of the present invention.

It is specifically contemplated that the primary basis on which a retrofit ability could be used to deploy the method of the present invention would be to produce a retrofit dispenser cover which could be capable of accepting a visual display module as is the case with the fully manufactured product dispensers of the present invention otherwise outlined herein. The dispenser cover 3 could be made in a replacement shape to replace the OEM shell for a product dispenser 1. A different dispenser cover 3 could be produced for different types of product dispenser 1 for which it was desired to retrofit with the active advertising ability of the present invention.

Advertising Method:

Another aspect of the present invention is an advertising method, by which the product dispenser for the display of active visual content of the present invention can be made available to a venue for their use. It is specifically contemplated that the venue owners may not want to pay for the deployment of advertising around visual media content in their establishments as it would simply add cost, but in certain cases they may be prepared to accept the deployment of advertising material in their establishments at no cost to them. It is specifically contemplated that a novel business method for the placement of visual media content as outlined elsewhere herein is enabled by the use of the active media display product dispenser outlined in the remainder of this application. At the highest level, this business method comprises the provision at no cost to a venue of active media display equipped product dispensers in exchange for the venue purchasing consumable or disposable dispensed products from the operator of the method. The operator of the method would then sell some or all of the advertising media content space on the dispensers in question to third parties who are interested in advertising those establishments. Ad purchasers received deployment of their content in desirable locations, and the locations receive the activated product dispensers which their customers may enjoy, along with discounted dispensed product inputs.

Figure 16:
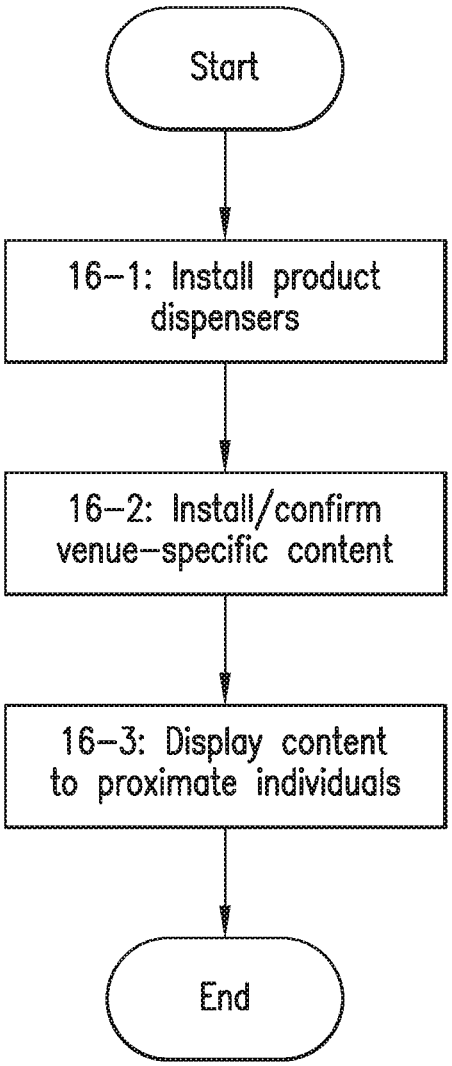
FIG. 16 is a flowchart of one embodiment of the advertising method of the present invention.

FIG. 16 is a flowchart demonstrating the steps of one embodiment of an advertising method in accordance with the present invention. There is disclosed a method of providing active advertising in the venue, which comprises a number of steps. The first step, shown at 16-1, comprising the placement of at least one product dispenser in a venue. The product dispensers would be the dispensers of hygiene, sanitation or any other type of a disposable product as outlined elsewhere herein which could be equipped with the remainder of the necessary modifications to allow for the display of active media content. Specifically, each product dispenser comprises a dispensing mechanism for storing and dispensing product, dispenser cover covering the dispensing mechanism and having the user facing surface, and a removable visual display module attached to the user facing surface and having an active media surface thereon which will display active visual content two of you are in proximity thereto—where individual content is installed on the active media surface for specific use in the venue.

The next step in the method is to confirm or install venue specific active visual content onto active media surface of the visual display module of each product dispenser installed within the venue. This is shown at step 16-2.

Following the installation of venue specific active visual content on the active media surface of the product dispensers installed in the venue, at step 16-2, the dispensers are used to display that active visual content to people in proximity to the dispensers, in accordance with the remainder of the system and method outlined herein.

The at least one product dispenser could be provided along with the active visual content to the venue for use at no cost, in exchange for the venue purchasing consumable products for dispersal from the vendor supplying the at least one product dispenser.

It will be apparent to those of skill in the art that by routine modification the present invention can be optimized for use in a wide range of conditions and application. It will also be obvious to those of skill in the art that there are various ways and designs with which to produce the apparatus and methods of the present invention. The illustrated embodiments are therefore not intended to limit the scope of the invention, but to provide examples of the apparatus and method to enable those of skill in the art to appreciate the inventive concept.

Those skilled in the art will recognize that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

We claim:

1. A product dispenser capable of providing active visual content to proximate viewers, said product dispenser comprising:

a. a dispensing mechanism for storing and dispensing a product;

b. a dispenser cover covering the dispensing mechanism and having a user-facing surface and a module recess; and c. a visual display module having an active media surface thereon which will display at least one visual media display option which can be selectively activated for display to a viewer in proximity thereto; wherein said visual display module is attached to the user-facing surface; and wherein the active media surface facing in the same direction as the user-facing surface;

wherein the active media surface is approximately coplanar with the user-facing surface of the product dispenser, and the visual display module includes a housing having a rear module surface not covering an entire rear surface of the visual display module and extending in a direction opposite the active media surface into the module recess of the dispenser cover;

wherein the module recess further comprises at least one module support to engage the rear module surface thereof, the at least one module support comprising a support flange extending entirely around the inner circumference of the module recess towards the center thereof, such that the visual display module is circumferentially engaged by the support flange when retained within the module recess; and wherein the module recess matches the size of the rear module surface of the housing.

2. The product dispenser of claim 1 wherein the visual display module is removeable and is held in place on the dispenser cover by releasable retaining means.

3. The product dispenser of claim 1 wherein the module support comprises a rear support surface covering the interior of the module recess.

4. The product dispenser of claim 1 wherein the dispenser cover and the dispensing mechanism are integrated.

5. The product dispenser of claim 1 wherein the dispenser cover is removeable from the dispensing mechanism.

6. The product dispenser of claim 5 further comprising attachment means to attach the dispenser cover to the dispensing mechanism.

7. The product dispenser of claim 1 wherein the visual display module comprises a power source and a controller which can operate in conjunction with the active media surface to provide the at least one visual media display option which can be selectively activated for display to the viewer by the controller.

8. The product dispenser of claim 6 wherein the active media surface comprises an electronic paper display.

9. The product dispenser of claim 1 wherein the visual content which can be selectively activated for display on the active media surface can be replaced.

10. The product dispenser of claim 1 wherein the dispensing mechanism is a roll dispensing apparatus and the product is a rolled paper product.

11. The product dispenser of claim 1 wherein the dispensing mechanism is a folded sheet dispensing apparatus and the product is a folded sheet paper product.

12. The product dispenser of claim 1 wherein the dispensing mechanism is a liquid reservoir with a dispensing valve, and the product is a liquid product.

* * * * *